US012203661B2

(12) United States Patent
Chung et al.

(10) Patent No.: US 12,203,661 B2
(45) Date of Patent: Jan. 21, 2025

(54) COOKING ENGAGEMENT SYSTEM USING IMAGE ANALYSIS

(71) Applicant: Haier US Appliance Solutions, Inc., Wilmington, DE (US)

(72) Inventors: Myunggeon Chung, Seoul (KR); Youngmin Han, Gwangju (KR); Jee Eun Oh, Gyeonggi (KR); Young Ryul Bae, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 420 days.

(21) Appl. No.: 17/833,007

(22) Filed: Jun. 6, 2022

(65) Prior Publication Data

US 2023/0392798 A1 Dec. 7, 2023

(51) Int. Cl.
*F24C 15/20* (2006.01)

(52) U.S. Cl.
CPC ..... *F24C 15/2021* (2013.01); *F24C 15/2042* (2013.01)

(58) Field of Classification Search
CPC ..... F24C 15/2021; F24C 15/2042
USPC ..... 126/299 R
See application file for complete search history.

(56) References Cited

U.S. PATENT DOCUMENTS 9,791,936 B1 * 10/2017 Kovach ..... G06F 3/04847
2010/0182136 A1 * 7/2010 Pryor ..... G06F 3/017 340/425.5
2011/0253693 A1 10/2011 Lyons et al.
2011/0317872 A1 * 12/2011 Free ..... G06V 40/165 382/118
2015/0374163 A1 12/2015 Spanóet al.
2017/0322632 A1 11/2017 Kovach
2018/0372332 A1 12/2018 Cha et al.

FOREIGN PATENT DOCUMENTS

CN 106383452 B 6/2020
EP 2615376 B1 4/2018
WO WO2020225303 A1 11/2020

* cited by examiner

*Primary Examiner* — Vivek K Shirsat
(74) *Attorney, Agent, or Firm* — Dority & Manning, P.A.

(57) ABSTRACT

A cooking engagement system includes a cooktop appliance defining a top surface, the cooktop appliance including a plurality of heating elements defined on the top surface, an image monitor spaced apart from the top surface of the cooktop appliance along the vertical direction, a camera assembly positioned above the cooktop appliance, and a controller operably coupled with the camera assembly and the cooktop appliance, the controller being configured to initiate an operation. The operation includes directing a capture of a first front image at the camera assembly, identifying a first user based on the first image, directing a capture of a first lower image at the camera assembly, establishing a first cooktop-use profile based on the first lower image, and associating the first user with the first cooktop-use profile.

20 Claims, 7 Drawing Sheets

COOKING ENGAGEMENT SYSTEM USING IMAGE ANALYSIS

FIELD OF THE INVENTION

The present subject matter relates generally to systems for aiding cooking operations, and more particularly to methods for monitoring and managing cooking engagement systems.

BACKGROUND OF THE INVENTION

Cooktop or range appliances generally include heating elements for heating cooking utensils, such as pots, pans, and griddles. A variety of configurations can be used for the heating elements located on the cooking surface of the cooktop. The number of heating elements or positions available for heating on the range appliance can include, for example, four, six, or more depending upon the intended application and preferences of the buyer. These heating elements can vary in size, location, and capability across the appliance.

In certain settings, multiple users may operate a single cooktop simultaneously, with each user occupying or operating an individual heating element. Common cooktop appliances include a separate user input or knob for each heating element, such that each user is able to manipulate an individual user input to operate their selected heating element. However, the multiple users may unintentionally manipulate an incorrect input and thus alter the cooking status of a fellow user, resulting in potentially ruined cooking operations.

As a result, it would be useful to provide a cooking engagement system that obviates one or more of the above identified issues. Particularly, a cooking engagement system that manages multiple cooking operations with one or more users would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking engagement system is provided. The cooking engagement system may include a cooktop appliance defining a top surface, the cooktop appliance including a plurality of heating elements defined on the top surface, a camera assembly positioned above the cooktop appliance, and a controller operably coupled with the camera assembly and the cooktop appliance, the controller being configured to initiate an operation. The operation may include directing a capture of a first front image at the camera assembly, identifying a first user based on the first front image, directing a capture of a first lower image at the camera assembly, establishing a first cooktop-use profile based on the first lower image, and associating the identified first user with the first cooktop-use profile.

In another exemplary aspect of the present disclosure, a method of operating a cooking engagement system is provided. The cooking engagement system may include a cooktop appliance including a top surface defining a plurality of heating elements, an image monitor provided above the cooktop appliance, and a camera assembly connected to the image monitor. The method may include activating the camera assembly to capture a first front image, performing a first image analysis on the first front image to recognize a first user, activating the camera assembly to capture a first lower image, performing a second image analysis on the first lower image to recognize a first heating element from the plurality of heating elements, and linking the first user with the first heating element to define a first cooktop-use profile.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
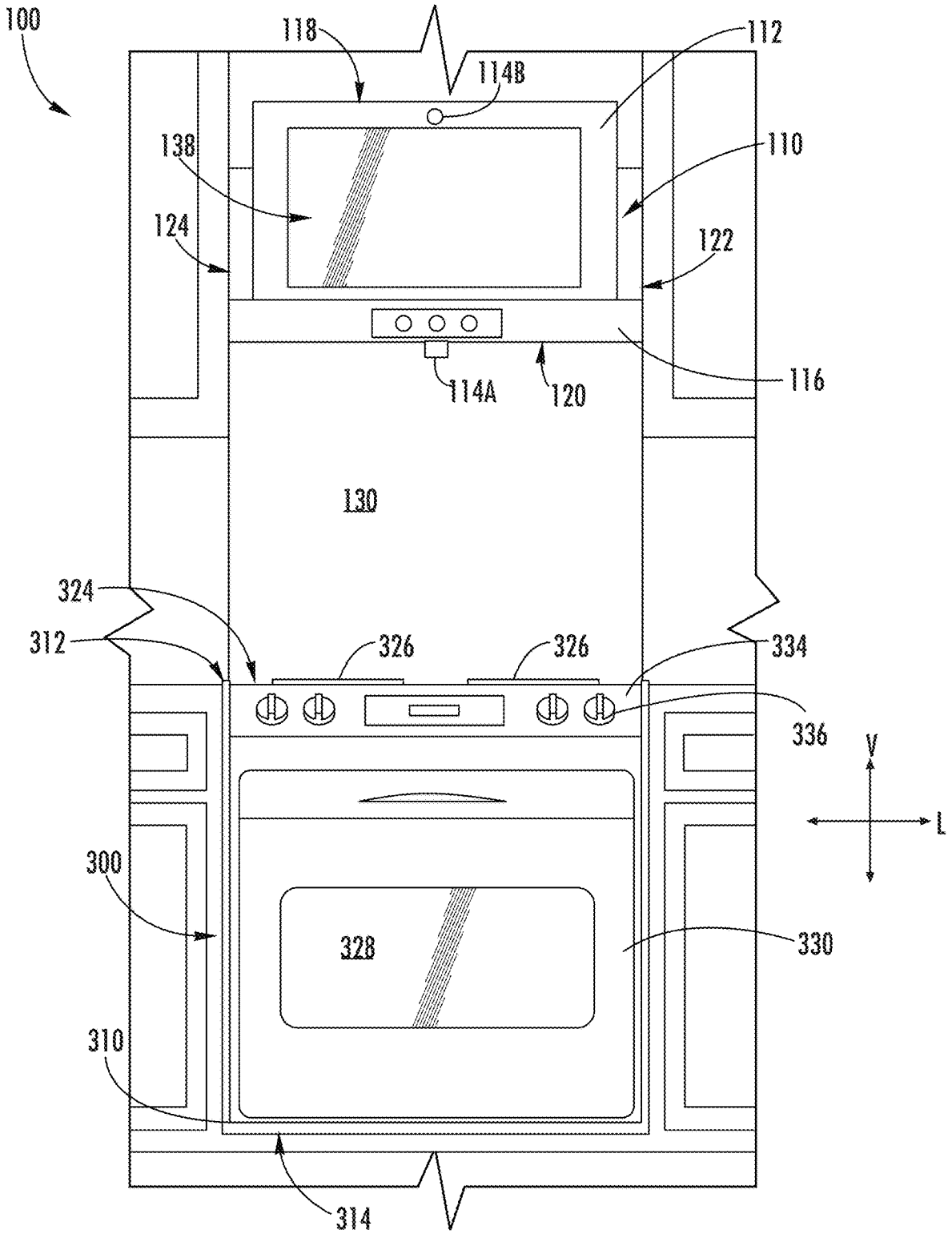
FIG. 1 provides a front perspective view of a system according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As shown cooking appliance 300 defines a vertical direction V, a lateral direction L, and a transverse direction T, for example, at a cabinet 310. The vertical, lateral, and transverse directions are mutually perpendicular and form an orthogonal direction system. As shown, cooking appliance 300 extends along the vertical direction V between a top portion 312 and a bottom portion 314; along the lateral direction L between a left side portion and a right side portion; and along the traverse direction T between a front portion and a rear portion.

Figure 2:
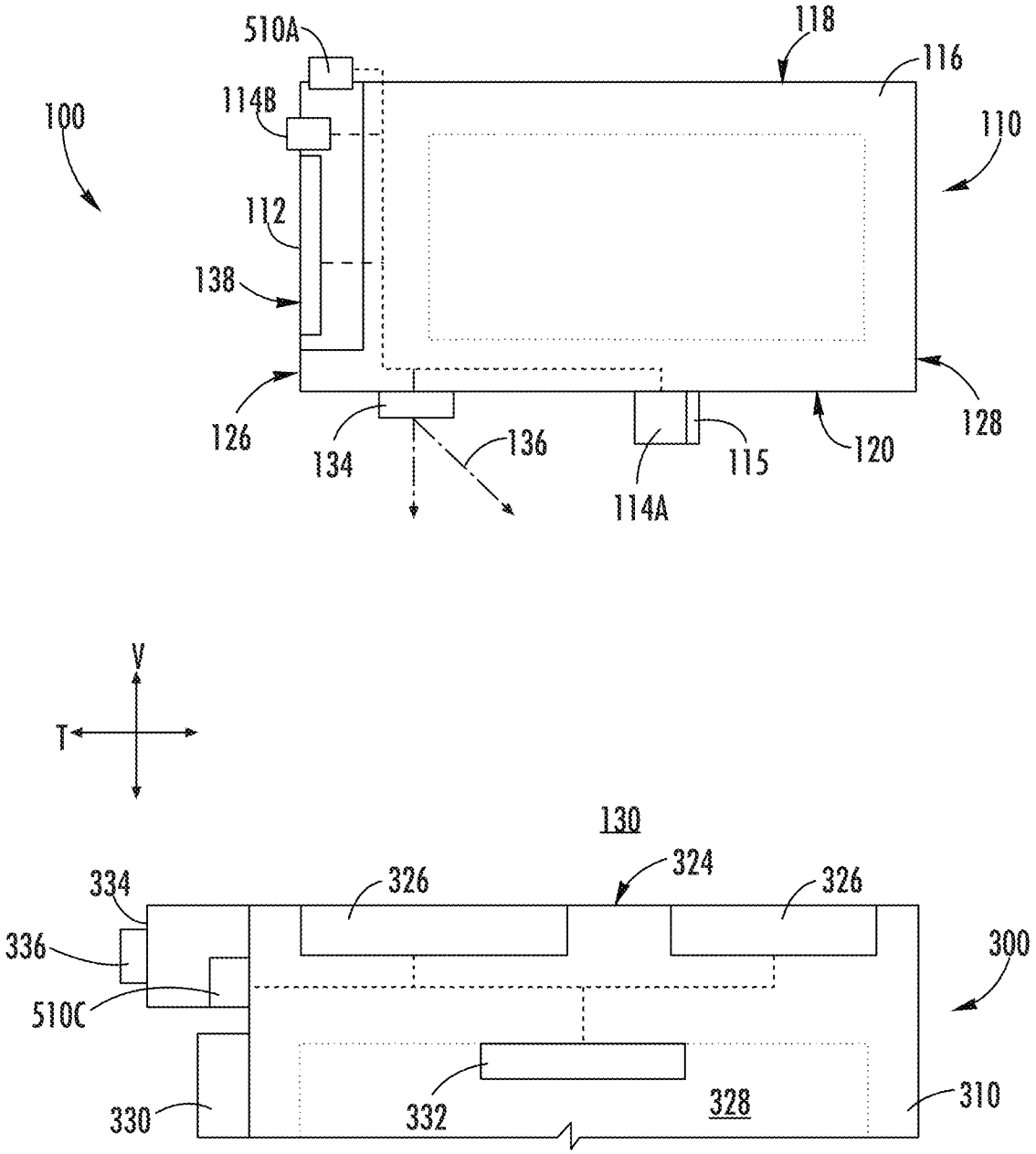
FIG. 2 provides a side schematic view of the exemplary system of FIG. 1.
Figure 3:
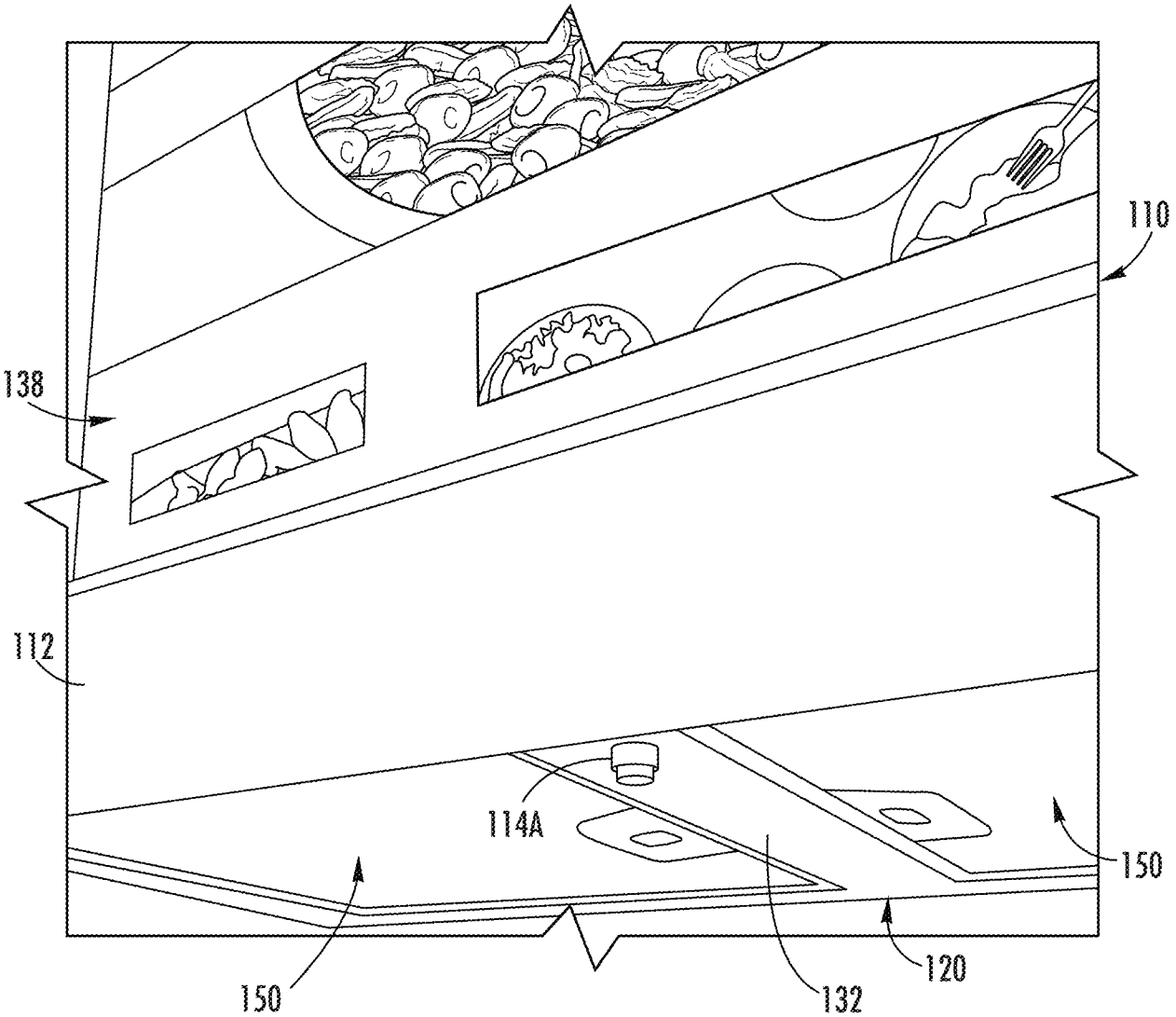
FIG. 3 provides a bottom perspective view of a portion of the exemplary system of FIG. 1.

Turning to the figures, FIGS. 1 through 3 provide various views of a system 100 according to exemplary embodiments of the present disclosure. System 100 generally includes a stationary interactive assembly 110 with which a user may interact or engage. Interactive assembly 110 may have a controller 510A in operable communication with an image monitor 112 and one or more camera assemblies (e.g., camera assembly 114A and camera assembly 114B) that are generally positioned above a cooking appliance 300.

Cooking appliance 300 can include a chassis or cabinet 310 and a cooktop surface 324 having one or more heating elements 326 for use in, for example, heating or cooking operations. In exemplary embodiments, cooktop surface 324 is constructed with ceramic glass. In other embodiments, however, cooktop surface 324 may include of another suitable material, such as a metallic material (e.g., steel) or another suitable non-metallic material. Heating elements 326 may be various sizes and may employ any suitable method for heating or cooking an object, such as a cooking utensil (not shown), and its contents. In one embodiment, for example, heating element 326 uses a heat transfer method, such as electric coils or gas burners, to heat the cooking utensil. In another embodiment, however, heating element 326 uses an induction heating method to heat the cooking utensil directly. In turn, heating element 326 may include a gas burner element, resistive heat element, radiant heat element, induction element, or another suitable heating element. It should be noted that one or more additional sensors may be included within cooktop surface 324 (e.g., at or adjacent to heating elements 326), such as weight sensors, contact sensors, proximity sensors, or the like for determining a positioning of cookware items or utensils thereon.

In some embodiments, cooking appliance 300 includes an insulated cabinet 310 that defines a cooking chamber 328 selectively covered by a door 330. One or more heating elements 332 (e.g., top broiling elements or bottom baking elements) may be enclosed within cabinet 310 to heat cooking chamber 328. Heating elements 332 within cooking chamber 328 may be provided as any suitable element for cooking the contents of cooking chamber 328, such as an electric resistive heating element, a gas burner, microwave element, halogen element, etc. Thus, cooking appliance 300 may be referred to as an oven range appliance. As will be understood by those skilled in the art, cooking appliance 300 is provided by way of example only, and the present subject matter may be used in any suitable cooking appliance, such as a double oven range appliance, stand-alone oven, wall-mounted oven, or a standalone cooktop (e.g., fitted integrally with a surface of a kitchen counter). Thus, the example embodiments illustrated in figures are not intended to limit the present subject matter to any particular cooking chamber or heating element configuration, except as otherwise indicated.

As illustrated, a user interface or user interface panel 334 may be provided on cooking appliance 300. Although shown at the front portion of cooking appliance 300, another suitable location or structure (e.g., a backsplash) for supporting user interface panel 334 may be provided in alternative embodiments. In some embodiments, user interface panel 334 includes input components or controls 336, such as one or more of a variety of electrical, mechanical, or electro-mechanical input devices. Controls 336 may include, for example, rotary dials, knobs, push buttons, and touch pads. A controller 510C is in communication with user interface panel 334 and controls 336 through which a user may select various operational features and modes and monitor progress of cooking appliance 300. In additional or alternative embodiments, user interface panel 334 includes a display component, such as a digital or analog display in communication with a controller 510C and configured to provide operational feedback to a user. In certain embodiments, user interface panel 334 represents a general purpose I/O ("GPIO") device or functional block.

As shown, controller 510C is communicatively coupled (i.e., in operative communication) with user interface panel 334 and its controls 336. Controller 510C may also be communicatively coupled with various operational components of cooking appliance 300 as well, such as heating elements (e.g., 326, 332), sensors, etc. Input/output ("I/O") signals may be routed between controller 510C and the various operational components of cooking appliance 300. Thus, controller 510C can selectively activate and operate these various components. Various components of cooking appliance 300 are communicatively coupled with controller 510C via one or more communication lines such as, for example, conductive signal lines, shared communication busses, or wireless communications bands.

Figure 4:
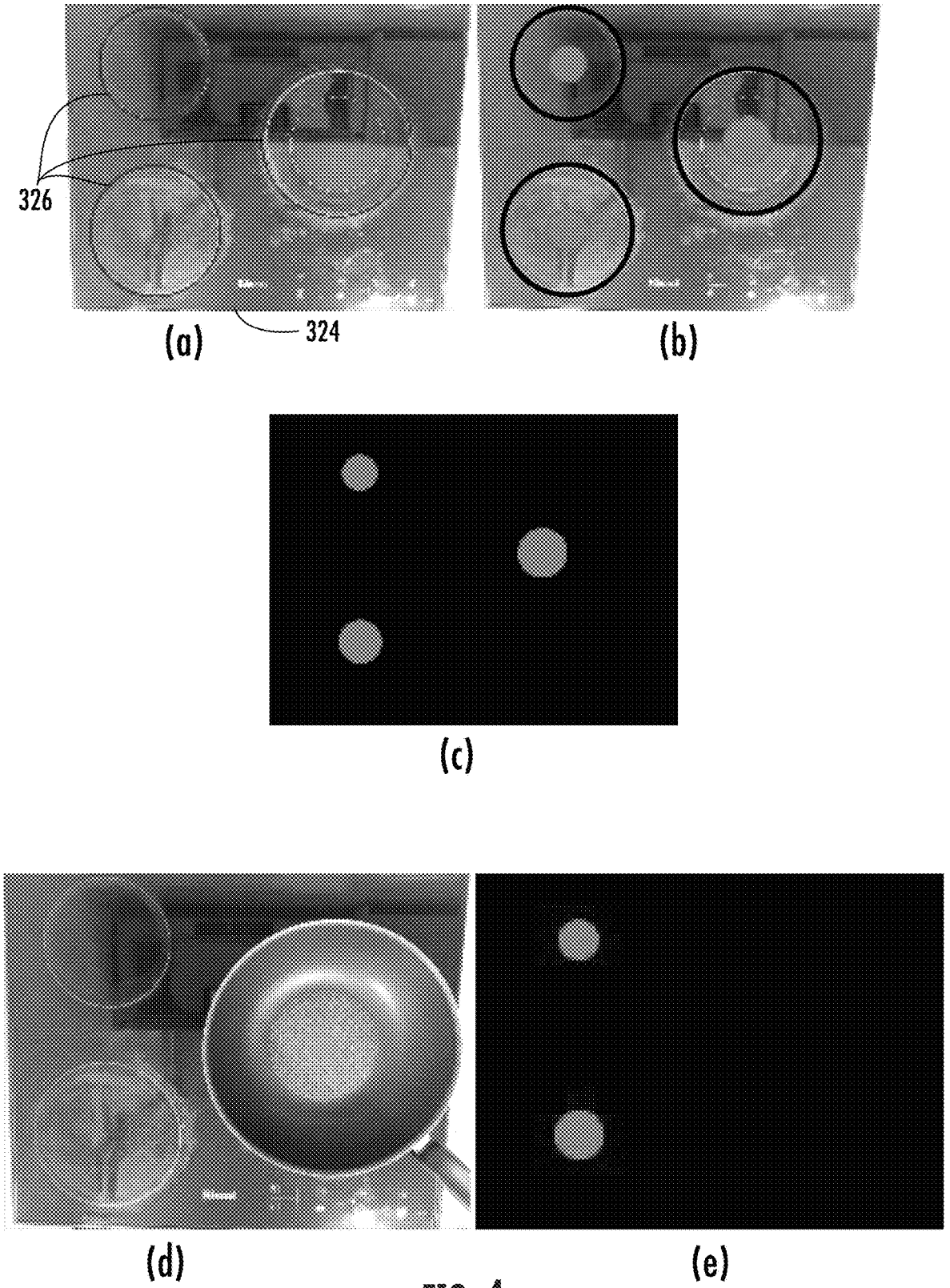
FIG. 4 provides a plurality of lower views of a cooktop appliance of the exemplary system of FIG. 1.

In some embodiments, controller 510C includes one or more memory devices 514C and one or more processors 512C (FIG. 4). The processors 512C can be any combination of general or special purpose processors, CPUs, or the like that can execute programming instructions or control code associated with operation of cooking appliance 300. The memory devices 514C (i.e., memory) may represent random access memory such as DRAM or read only memory such as ROM or FLASH. In one embodiment, the processor 512C executes programming instructions stored in memory 514C. The memory 514C may be a separate component from the processor 512C or may be included onboard within the processor 512C. Alternatively, controller 510C may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510C includes a network interface 520C (FIG. 4) such that controller 510C can connect to and communicate over one or more networks (e.g., network 502—FIG. 4) with one or more network nodes. Controller 510C can also include one or more transmitting, receiving, or transceiving components for transmitting/receiving communications with other devices communicatively coupled with cooking appliance 300. Additionally or alternatively, one or more transmitting, receiving, or transceiving components can be located off board controller 510C. Generally, controller 510C can be positioned in any suitable location throughout cooking appliance 300. For example, controller 510C may be located proximate user interface panel 334 toward the front portion of cooking appliance 300.

As shown, one or more casings (e.g., hood casing 116) may be provided above cooking appliance 300 along the vertical direction V. For example, a hood casing 116 may be positioned above cooking appliance 300 in a stationary mounting (e.g., such that operation of interactive assembly 110 is not permitted unless casing 116 is mounted at a generally fixed or non-moving location). Hood casing 116 includes a plurality of outer walls and generally extends along the vertical direction V between a top end 118 and a bottom end 120; along the lateral direction L between a first side end 122 and a second side end 124; and along the transverse direction T between a front end 126 and a rear end 128. In some embodiments, hood casing 116 is spaced apart from cooktop surface 324 along the vertical direction V. An open region 130 may thus be defined along the vertical direction V between cooktop surface 324 and bottom end 120.

In optional embodiments, hood casing 116 is formed as a range hood. A ventilation assembly within hood casing 116 may thus direct an airflow from the open region 130 and through hood casing 116. However, a range hood is provided by way of example only. Other configurations may be used within the spirit and scope of the present disclosure. For example, hood casing 116 could be part of a microwave or other appliance designed to be located above cooking appliance 300 (e.g., directly above cooktop surface 324). Moreover, although a generally rectangular shape is illustrated, any suitable shape or style may be adapted to form the structure of hood casing 116.

In certain embodiments, one or more camera assemblies 114A, 114B are provided to capture images (e.g., static images or dynamic video) of a portion of cooking appliance 300 or an area adjacent to cooking appliance 300. Generally, each camera assembly 114A, 114B may be any type of device suitable for capturing a picture or video. As an example, each camera assembly 114A, 114B may be a video camera or a digital camera with an electronic image sensor [e.g., a charge coupled device (CCD) or a CMOS sensor]. A camera assembly 114A or 114B is generally provided in operable communication with controller 510A such that controller 510A may receive an image signal from camera assembly 114A or 114B corresponding to the picture captured by camera assembly 114A or 114B. Once received by controller 510A, the image signal may be further processed at controller 510A or transmitted to a separate device (e.g., remote server 404—FIG. 4) in live or real-time for remote viewing (e.g., via one or more social media platforms). Optionally, one or more microphones (not pictured) may be associated with one or more of the camera assemblies 114A, 114B to capture and transmit audio signal(s) coinciding (or otherwise corresponding) with the captured image signal(s).

In some embodiments, one camera assembly (e.g., first camera assembly 114A) is directed at cooktop surface 324. In other words, first camera assembly 114A is oriented to capture light emitted or reflected from cooktop surface 324 through the open region 130. Thus, first camera assembly 114A may selectively capture an image covering all or some of cooktop surface 324. For instance, first camera assembly 114A may capture an image covering one or more heating elements 326 of cooking appliance 300. Optionally, first camera assembly 114A may be directed such that a line of sight is defined from first camera assembly 114A that is perpendicular to cooktop surface 324.

As shown, first camera assembly 114A is positioned above cooktop surface 324 (e.g., along the vertical direction V). In some such embodiments, first camera assembly 114A is mounted (e.g., fixedly or removably) to hood casing 116. A cross-brace 132 extending across hood casing 116 (e.g., along the transverse direction T) may support first camera assembly 114A. When assembled, first camera assembly 114A may be positioned directly above cooktop surface 324.

In additional or alternative embodiments, one camera assembly (e.g., second camera assembly 114B) is directed away from cooktop surface 324. In other words, second camera assembly 114B is oriented to capture light emitted or reflected from an area other than cooktop surface 324. In particular, second camera assembly 114B may be directed at the area in front of cooking appliance 300 (e.g., directly forward from cooking appliance 300 along the transverse direction T). Thus, second camera assembly 114B may selectively capture an image of the area in front of cooktop surface 324. This area may correspond to or cover the location where a user would stand during use of cooking appliance 300. During use, a user's face or body may be captured by second camera assembly 114B while the user is standing directly in front of cooking appliance 300. Optionally, second camera assembly 114B may be directed such that a line of sight is defined from second camera assembly 114B that is non-orthogonal to cooktop surface 324 (e.g., between 0° and 45° relative to a plane parallel to cooktop surface 324). The captured images from second camera assembly 114B may be suitable for transmission to a remote device or may be processed as part of one or more operations of interactive assembly 110, such as a gesture control signal for a portion of interactive assembly 110 (e.g., to engage a graphical user interface displayed at image monitor 112).

As shown, second camera assembly 114B is positioned above cooking appliance 300 (e.g., along the vertical direction V). In some such embodiments, such as that illustrated in FIGS. 1 and 2, second camera assembly 114B is mounted (e.g., fixedly or removably) to a front portion of hood casing 116 (e.g., at image monitor 112). When assembled, second camera assembly 114B may be positioned directly above a portion of cooking appliance 300 (e.g., cooktop surface 324) or, additionally, forward from cooking appliance 300 along the transverse direction T.

In optional embodiments, a lighting assembly 134 is provided above cooktop surface 324 (e.g., along the vertical direction V). For instance, lighting assembly 134 may be mounted to hood casing 116 (e.g., directly above cooktop surface 324). Generally, lighting assembly 134 includes one or more selectable light sources directed toward cooktop surface 324. In other words, lighting assembly 134 is oriented to project a light (as indicated at arrows 136) to cooking appliance 300 through open region 130 and illuminate at least a portion of cooktop surface 324. The light sources may include any suitable light-emitting elements, such as one or more light emitting diode (LED), incandescent bulb, fluorescent bulb, halogen bulb, etc.

In some embodiments, image monitor 112 is provided above cooktop surface 324 (e.g., along the vertical direction V). For instance, image monitor 112 may be mounted to hood casing 116 (e.g., above cooking appliance 300). Generally, image monitor 112 may be any suitable type of mechanism for visually presenting a digital (e.g., interactive) image. For example, image monitor 112 may be a liquid crystal display (LCD), a plasma display panel (PDP), a cathode ray tube (CRT) display, etc. Thus, image monitor 112 includes an imaging surface 138 (e.g., screen or display panel) at which the digital image is presented or displayed as an optically-viewable picture (e.g., static image or dynamic video) to a user. The optically-viewable picture may correspond to any suitable signal or data received or stored by interactive assembly 110 (e.g., at controller 510A). As an example, image monitor 112 may present notices or messages in the form of viewable text or images. As another example, image monitor 112 may present a remotely captured image, such as a live (e.g., real-time) dynamic video stream received from a separate user or device. As yet another example, image monitor 112 may present a graphical user interface (GUI) that allows a user to select or manipulate various operational features of interactive assembly 110 or cooking appliance 300. During use of such GUI embodiments, a user may engage, select, or adjust the image presented at image monitor 112 through any suitable input, such as gesture controls detected through second camera assembly 114B, voice controls detected through one or more microphones, associated touch panels (e.g., capacitance or resistance touch panel) or sensors overlaid across imaging surface 138, etc.

As illustrated, the imaging surface 138 generally faces, or is directed away from, cooking appliance (e.g., cooktop surface 324 or cabinet 310). In particular, the imaging surface 138 is directed toward the area forward from the cooking appliance 300. During use, a user standing in front of cooking appliance 300 may thus see the optically-viewable picture (e.g., recipe, dynamic video stream, graphical user interface, etc.) displayed at the imaging surface 138. Optionally, the imaging surface 138 may be positioned at a rearward non-orthogonal angle relative to the vertical direction. In other words, the imaging surface 138 may be inclined such that an upper edge of the imaging surface 138 is closer to the rear end 128 of hood casing 116 than a lower edge of the imaging surface 138 is. In some such embodiments, the non-orthogonal angle is between 1° and 15° relative to the vertical direction V. In certain embodiments, the non-orthogonal angle is between 2° and 7° relative to the vertical direction V.

Figure 6:
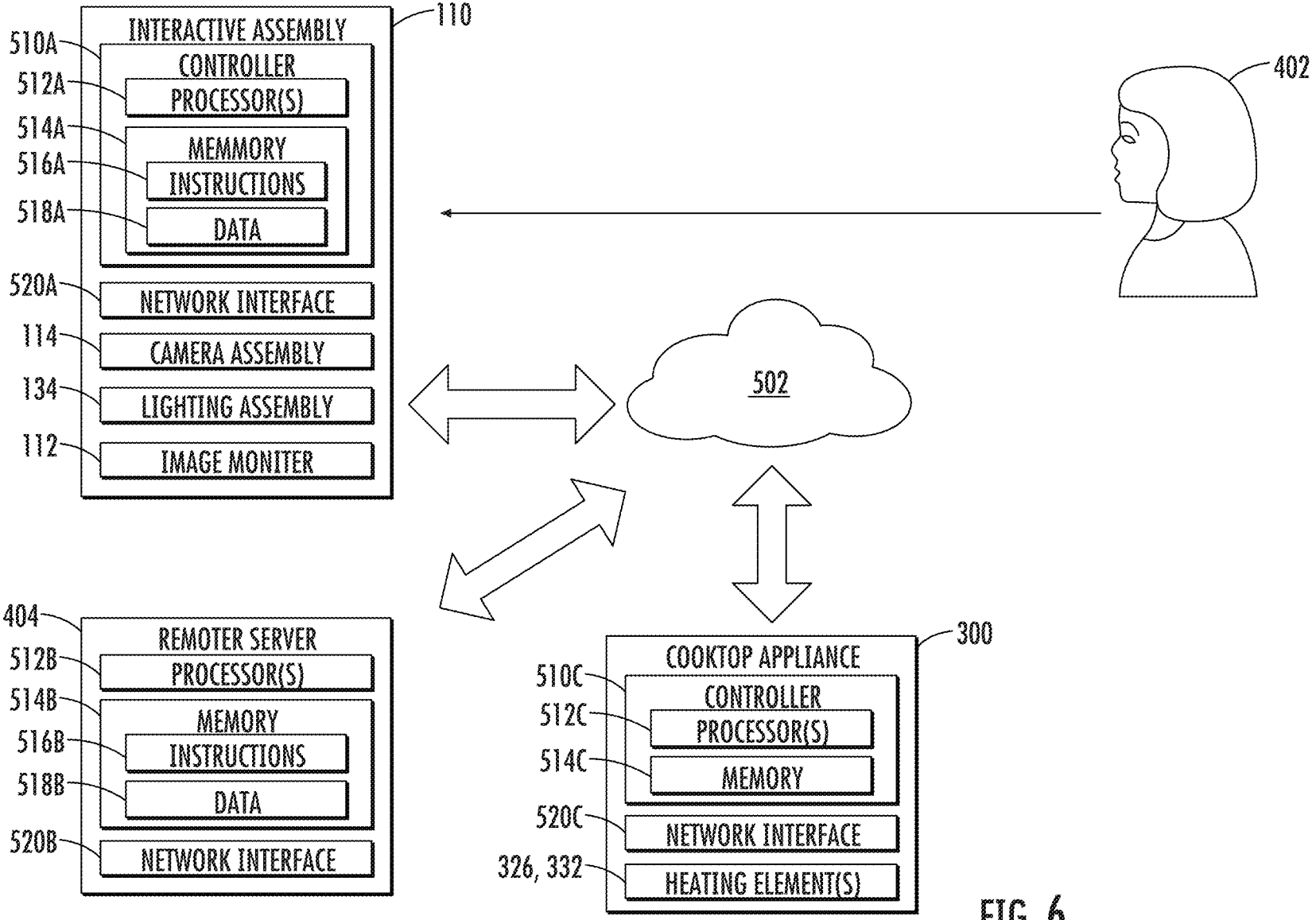
FIG. 6 provides a schematic view of a system for user engagement according to exemplary embodiments of the present disclosure.

FIG. 6 provides a schematic view of a system for user engagement according to exemplary embodiments of the present disclosure. As shown, interactive assembly 110 can be communicatively coupled with network 502 and various other nodes, such as a remote server 404, cooking appliance 300, and/or one or more user devices. Moreover, one or more users 402 can be in operative communication with interactive assembly 110 by various methods, including voice control or gesture recognition, for example. Additionally, or alternatively, although network 502 is shown, one or more portions of the system (e.g., interactive assembly 110, cooking appliance 300, user device 408, or other devices within system) may be communicatively coupled without network 502; rather, interactive assembly 110 and various other devices of the system can be communicatively coupled via any suitable wired or wireless means not over network 502, such as, for example, via physical wires, transceiving, transmitting, or receiving components.

As noted above, interactive assembly 110 may include controller 510A operably coupled to one or more camera assemblies 114, lighting assemblies 134, and image monitors 110. Controller 510A may include one or more processors 512A and one or more memory devices 514A (i.e., memory). The one or more processors 512A can be any suitable processing device (e.g., a processor core, a microprocessor, an ASIC, a FPGA, a microcontroller, etc.) and can be one processor or a plurality of processors that are operatively connected. The memory device 514A can include one or more non-transitory computer-readable storage mediums, such as RAM, ROM, EEPROM, EPROM, flash memory device, magnetic disks, etc., and combinations thereof. The memory devices 514A can store data 518A and instructions 516A that are executed by the processor 512A to cause interactive assembly 110 to perform operations. For example, instructions 516A could be instructions for voice recognition, instructions for gesture recognition, receiving/transmitting images or image signals from camera assembly 114, directing activation of lighting assembly 134, or projecting images at image monitor 112. The memory devices 514A may also include data 518A, such as captured image data, notification or message data, etc., that can be retrieved, manipulated, created, or stored by processor 512A.

Controller 510A includes a network interface 520A such that interactive assembly 110 can connect to and communicate over one or more networks (e.g., network 502) with one or more network nodes. Network interface 520A can be an onboard component of controller 510A or it can be a separate, off board component. Controller 510A can also include one or more transmitting, receiving, or transceiving components for transmitting/receiving communications with other devices communicatively coupled with interactive assembly 110. Additionally or alternatively, one or more transmitting, receiving, or transceiving components can be located off board controller 510A.

Network 502 can be any suitable type of network, such as a local area network (e.g., intranet), wide area network (e.g., internet), low power wireless networks [e.g., Bluetooth Low Energy (BLE)], or some combination thereof and can include any number of wired or wireless links. In general, communication over network 502 can be carried via any type of wired or wireless connection, using a wide variety of communication protocols (e.g., TCP/IP, HTTP, SMTP, FTP), encodings or formats (e.g., HTML, XML), or protection schemes (e.g., VPN, secure HTTP, SSL).

In some embodiments, a remote server 404, such as a web server, is in operable communication with interactive assembly 110. The server 404 can be used to host an information database. The server can be implemented using any suitable computing device(s). The server 404 may include one or more processors 512B and one or more memory devices 514B (i.e., memory). The one or more processors 512B can be any suitable processing device (e.g., a processor core, a microprocessor, an ASIC, a FPGA, a microcontroller, etc.) and can be one processor or a plurality of processors that are operatively connected. The memory device 512B can include one or more non-transitory computer-readable storage mediums, such as RAM, ROM, EEPROM, EPROM, flash memory devices, magnetic disks, etc., and combinations thereof. The memory devices 514B can store data 518B and instructions 516B which are executed by the processor 512B to cause remote server 404 to perform operations. For example, instructions 516B could be instructions for receiving/transmitting images or image signals, transmitting/receiving recipe signals, etc.

The memory devices 514B may also include data 518B, such as social media data, notification data, message data, image data, etc., that can be retrieved, manipulated, created, or stored by processor 512B. The data 518B can be stored in one or more databases. The one or more databases can be connected to remote server 404 by a high bandwidth LAN or WAN, or can also be connected to remote server 404 through network 502. The one or more databases can be split up so that they are located in multiple locales.

Remote server 404 includes a network interface 520B such that interactive remote server 404 can connect to and communicate over one or more networks (e.g., network 502) with one or more network nodes. Network interface 520B can be an onboard component or it can be a separate, off board component. In turn, remote server 404 can exchange data with one or more nodes over the network 502. In particular, remote server 404 can exchange data with interactive assembly 110. Although not pictured, it is understood that remote server 404 may further exchange data with any number of client devices over the network 502. The client devices can be any suitable type of computing device, such as a general purpose computer, special purpose computer, laptop, desktop, integrated circuit, mobile device, smartphone, tablet, or other suitable computing device. In the case of a social media platform, images (e.g., static images or dynamic video), audio, or text may thus be exchanged between interactive assembly 110 and various separate client devices through remote server 404.

In optional embodiments, cooking appliance 300 is in operable communication with interactive assembly 110 via network 502. In turn, controller 510C of cooking appliance 300 may exchange signals with interactive assembly 110. Optionally, one or more portions of cooking appliance 300 may be controlled according to signals received from controller 510A of interactive assembly 110. For instance, one or more heating elements 326, 332 of cooking appliance 300 may be activated or directed to a specific heat output (e.g., in units of British Thermal Units or temperature) based on one or more instruction signals received from controller 510A of interactive assembly 110 or remote server 404.

Generally, user 402 may be in operative communication with interactive assembly 110, cooking appliance 300, or one or more user devices. In some exemplary embodiments, user 402 can communicate with devices (e.g., interactive assembly 110) using voice control. User 402 may also be in operative communication via other methods as well, such as visual communication.

Figure 7:
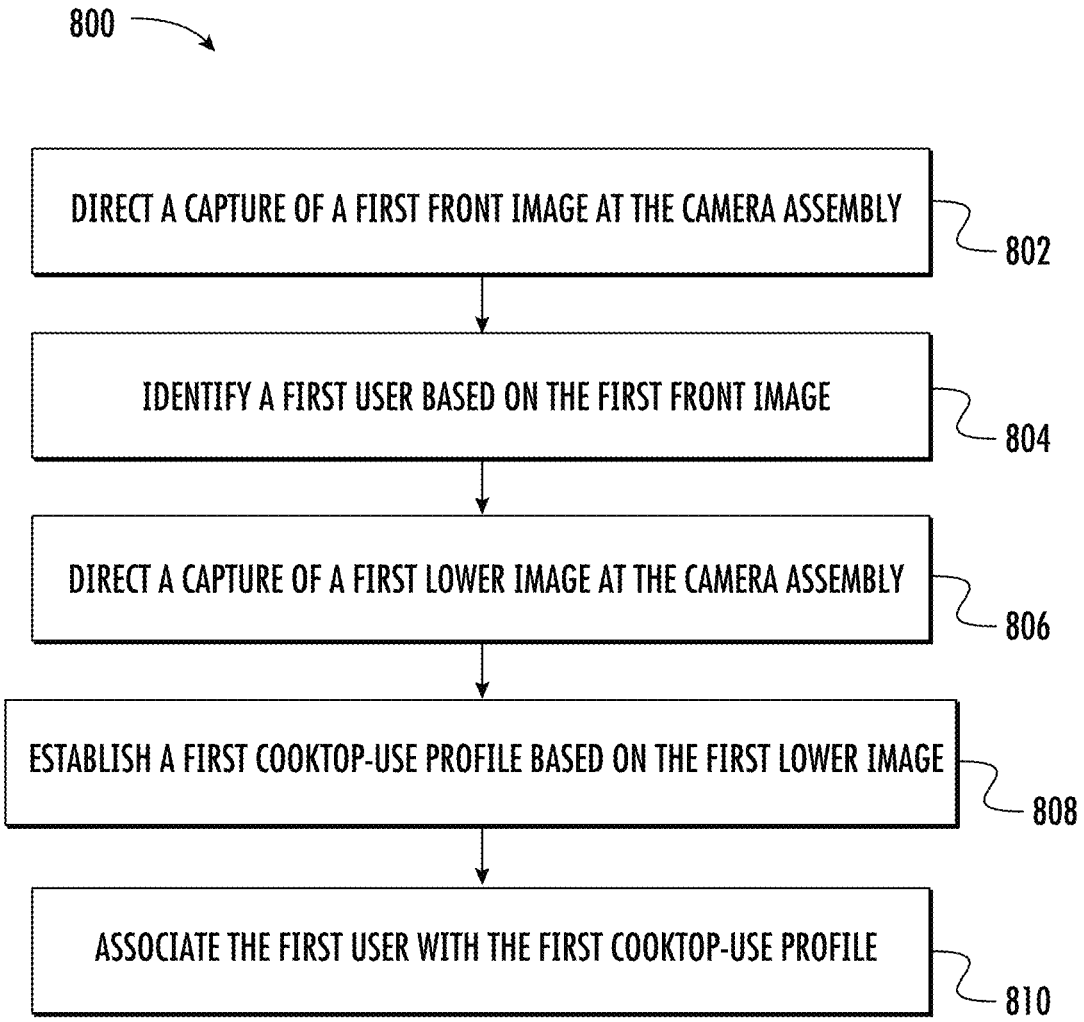
FIG. 7 provides a flow chart illustrating a method of operating a system according to exemplary embodiments of the present disclosure.

Referring now to FIG. 7, a method may be provided for use with system 100 (FIG. 1) in accordance with the present disclosure. In general, the various steps of the method as disclosed herein may, in exemplary embodiments, be performed by the controller 510A (FIG. 4) as part of an operation that the controller 510A is configured to initiate (e.g., a message-display operation). During such method, controller 510A may receive inputs and transmit outputs from various other components of the system 100. For example, controller 510A may send signals to and receive signals from remote server 404, cooking appliance 300, or user device 408, as well as other components within interactive assembly 110 (FIG. 4). In particular, the present disclosure is further directed to a method, as indicated by 800, for operating system 100.

Figure 5:
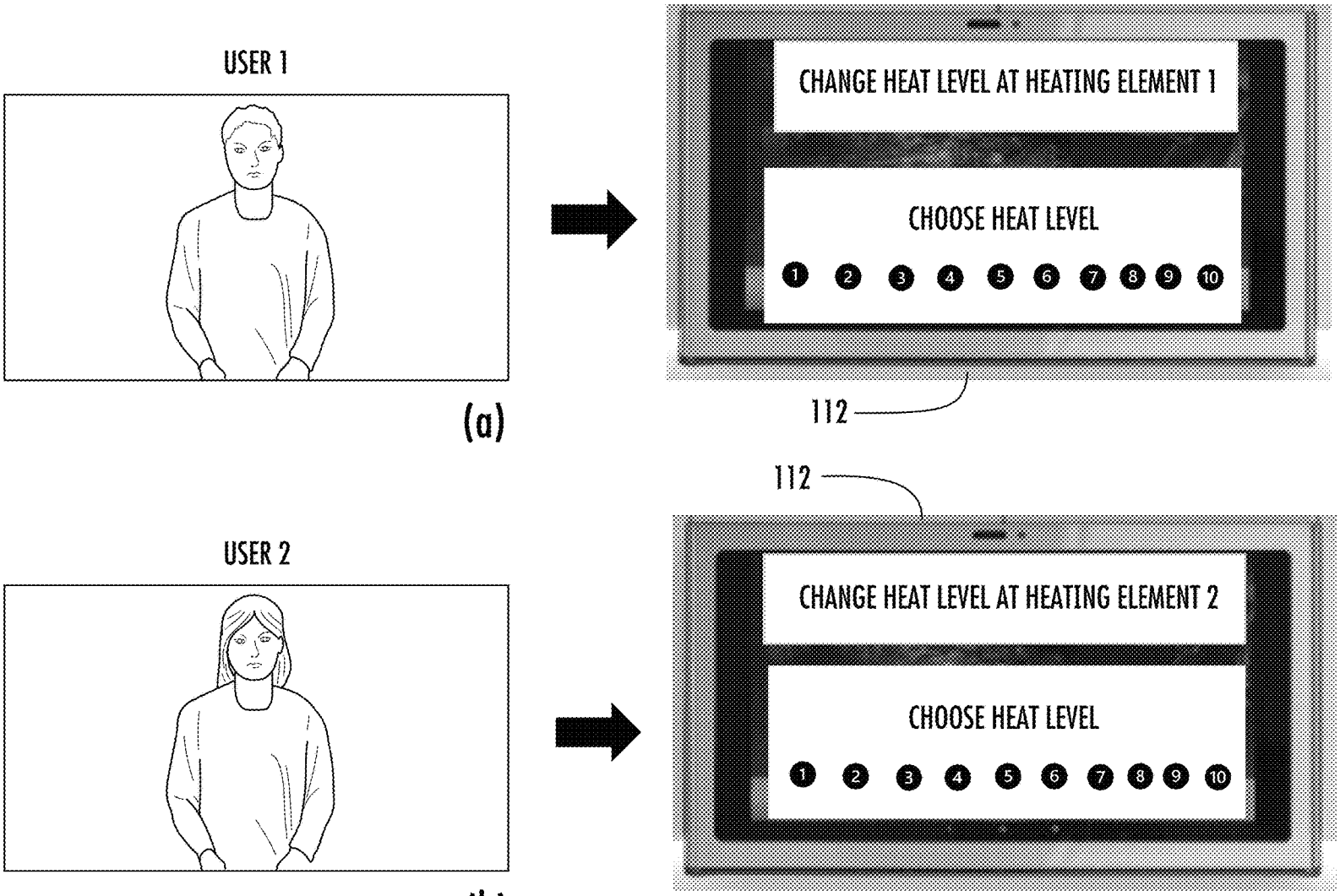
FIG. 5 provides an illustrated example of an operation performed by the exemplary system of FIG. 1.

FIG. 7 depicts steps performed in a particular order for purpose of illustration and discussion. Those of ordinary skill in the art, using the disclosures provided herein, will understand that (except as otherwise indicated) the steps of the method disclosed herein can be modified, adapted, rearranged, omitted, or expanded in various ways without deviating from the scope of the present disclosure. Additionally or alternatively, method 800 will be described with references to FIGS. 4 and 5 as well.

At step 802, method 800 may include directing a capture of a first front image at a camera assembly. In detail, with reference to FIG. 5, a camera assembly (e.g., second camera assembly 114B) provided within the operating system may capture a first front image. The camera assembly may be focused generally along the transverse direction (e.g., toward a front of the operating system). The first front image may thus include an area directly in front of the operating system, for instance, in front of a cooking or cooktop appliance (e.g., cooktop appliance 300). The first front image may thus include a first front image signal.

Although the term "image" or "image signal" is used herein, it should be appreciated that according to exemplary embodiments, the camera assembly may take any suitable number or sequence of two-dimensional images, videos, or other visual representations. For example, the captured images may include a video feed or series of sequential static images obtained by the camera assembly that may be transmitted to the controller (e.g., as a data signal) for analysis or other manipulation. These obtained images may vary in number, frequency, angle, field-of-view, resolution, detail, etc.

The first front image signal may be received at the controller of the interactive assembly. As described above, the camera assembly may be directed toward an area in front of the cooking appliance and the interactive assembly. For instance, the camera assembly may be mounted to the interactive assembly at a front portion thereof. Thus, the first front image signal may generally correspond to or provide a picture of the area in front of the interactive assembly. If a user is standing in front of the interactive assembly or cooking appliance, that user may be captured in the first front image from the camera assembly. Advantageously, the system may have a visual indication that the user is positioned in view of the image monitor of the interactive assembly. Optionally, at least a portion of the image monitor may provide a real time video feed for the camera assembly. In other words, the image monitor may mirror what images or image signals are captured by camera assembly. A user may thus have an immediate visible indication of what the camera assembly "sees" (i.e., detects) and what information is included in the first front image signal.

At step 804, method 800 may include identifying a first user based on the first front image. In detail, the received first front image signal may be evaluated or analyzed in order to find an indication that the user was or is positioned in front of the camera assembly and image monitor. According to exemplary embodiments, this image analysis may use any suitable image processing technique, image recognition process, etc. As used herein, the terms "image analysis" and the like may be used generally to refer to any suitable method of observation, analysis, image decomposition, feature extraction, image classification, etc. of one or more images, videos, or other visual representations of an object. As explained in more detail below, this image analysis may include the implementation of image processing techniques, image recognition techniques, or any suitable combination thereof. In this regard, the image analysis may use any suitable image analysis software or algorithm to constantly or periodically monitor, for example, a user positioned in front of the camera assembly. It should be appreciated that this image analysis or processing may be performed locally (e.g., by the controller) or remotely (e.g., by offloading image data to a remote server or network).

Specifically, the analysis of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities and/or differences between the reference image and the obtained image may be used to extract useful information for improving appliance performance.

According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the controller based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In addition to the image processing techniques described above, the image analysis may include utilizing artificial intelligence ("AI"), such as a machine learning image recognition process, a neural network classification module, any other suitable artificial intelligence (AI) technique, and/or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models. According to exemplary embodiments, it should be appreciated that the machine learning models may include supervised and/or unsupervised models and methods. In this regard, for example, supervised machine learning methods (e.g., such as targeted machine learning) may help identify problems, anomalies, or other occurrences which have been identified and trained into the model. By contrast, unsupervised machine learning methods may be used to detect clusters of potential failures, similarities among data, event patterns, abnormal concentrations of a phenomenon, etc.

It should be appreciated that image processing and machine learning image recognition processes may be used together to facilitate improved image analysis, object detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

Accordingly, the controller may identify and register or recognize a first user from the first front image. Subsequently, the controller may store the first user (i.e., a personalized data profile corresponding to the identified first user) within a memory (e.g., memory 514A). Additionally or alternatively, as described briefly above, multiple first front images may be captured by the camera assembly to generate a robust analysis of the first user.

At step 806, method 800 may include directing a capture of a first lower image at the camera assembly. In detail, the controller may instruct (or otherwise be triggered) to capture a first lower image. The first lower image may be directed generally toward a cooktop surface (e.g., cooktop surface 324). For instance, the camera assembly (e.g., first camera assembly 114A) may capture one or more images including one or more heating elements on the cooktop surface.

Once the first lower image is captured, the method 800 may further include analyzing the first lower image. For instance, one or more image analyses may be performed on the captured image(s). At the outset, the method 800 may include analyzing the captured image to identify or discern the one or more heating elements. For instance, an outer circumference (or other predetermined fiducial marker or point of reference) of each heating element may be recognized (e.g., as shown in (a) of FIG. 4). According to one example, the method 800 includes a position of an outermost ring of each heating element in the captured image. A center point of each heating element may then be virtually recognized (e.g., as shown in (b) of FIG. 4). The method 800 may then include creating a virtual representation of the cooktop surface including the center points of each heating element (e.g., as shown in (c) of FIG. 4). This virtual representation may be stored, for example, within the memory (e.g. provided on board the interactive system or stored in the cloud). The image analyses may be performed in similar manners as described above with respect to the first front image. Additionally or alternatively, the image analyses may be performed on board the cooktop appliance, within the image monitor, on a remote server, or on a combination of one or more additional controllers.

The camera assembly may capture additional images. For instance, the controller may determine (e.g., sense, alert, verify, etc.) that a cooking utensil has been placed on the cooktop surface (e.g., via a weight sensor, a motion detection, or the like). The camera assembly may then capture another image of the cooktop surface (e.g., as shown in (d) of FIG. 4) including the cooking utensil positioned thereon. By comparing the second captured image with the virtual representation, the controller may determine that the cooking utensil is covering at least one heating element. According to some embodiments, the controller determines that the cooking utensil is covering at least 80% of one heating element. For instance, the method 800 may include comparing a surface area of the cooking utensil with a surface area of the heating element. Additionally or alternatively, a circumference of the cooking utensil may be compared with the outer circumference of the heating element to determine the coverage of the heating element (for example, via a relative overlapping of each circumference).

At step 808, method 800 may include establishing a first cooktop-use profile based on the first lower image. For instance, the controller may perform a second image analysis on the first lower image (or first lower image signal). In performing the image analysis (e.g., as described above), the controller may determine that a particular heating element (e.g., a first heating element) is sufficiently covered by a cooking utensil. The amount of surface area of the heating element which is covered in order to trigger the first cooktop-use profile may vary. For one example, as mentioned above, the controller determines that at least 80% of the first heating element is covered.

The controller may, via the virtual representation of the cooktop surface, determine which heating element among the plurality of heating elements is covered. For instance, the cooktop surface may include a front left heating element, a rear left heating element, and a right heating element. In analyzing or evaluating the first lower image, the controller may determine that the right heating element is covered. In detail, by perceiving an object (e.g., the cooking utensil) on the cooktop surface, the controller may discern that the object covers the first heating element (e.g., by at least 80%). Accordingly, the controller determines that the covered heating element (first heating element) is intended to be used.

At step 810, method 800 may include associating the first user with the first cooktop-use profile. In detail, upon performing the image analysis on the first lower image and determining that the heating element is covered (e.g., by at least 80%) by the cooking utensil, the controller may associate or link the first user (identified via the first front image) with the covered heating element (or first heating element, identified via the first lower image). The first cooktop-use profile may thus refer to (e.g., operationally link) the first user and the first heating element.

The first cooktop-use profile may include a first set of controls for controlling the first heating element. In detail, the first set of controls may be virtual or touch controls presented on the image monitor. The first set of controls may include one or more touch locations visually presented on the image monitor for the first user to touch to control the first heating element. In some embodiments, the first set of controls includes a plurality of numbers spaced apart. Each of the plurality of numbers may represent a heating level (e.g., heat output from the first heating element). The first set of controls may allow for manipulation of only the first heating element. As would be understood, any suitable controls may be applied as the first set of controls and the disclosure is not limited to the examples given herein.

The system may continually operate the camera assembly to take subsequent pictures (e.g., subsequent front pictures and subsequent lower pictures). In a subsequent front picture, the method 800 may include recognizing the first user again. For instance, the first cooktop-use profile may be activated when the first user is subsequently recognized (e.g., by the camera assembly). For one example, when the first user approaches the cooktop appliance, the camera assembly recognizes the first user (e.g., through an image analysis comparison). The controller may then activate the first set of controls to control an output of the first heating element. As described above, the heating elements may be controlled by touch controls presented on the image monitor. Accordingly, the controller may present the first set of controls associated with the first heating element of the first cooktop-use profile on the image monitor upon recognizing the first user at the cooktop appliance (e.g., as shown in (a) of FIG. 5).

The first user may perform the cooking operation utilizing the first heating element and the first set of controls. After completing the cooking operation, the first user may input a command to cease an operation of the first heating element (i.e., to turn off power to the first heating element). The controller may then adjust the first cooktop-use profile. For instance, the controller may delink or disassociate the first user with the first heating element, or otherwise delete the first cooktop-use profile.

The controller may store additional cooktop-use profiles. For instance, after establishing the first cooktop-use profile (e.g., recognizing the first user, recognizing the first heating element, associating the first user with the first heating element), the camera assembly may capture a second front image. The second front image may include a second user different from the first user. Thus, the controller may identify and register the second user apart from the first user. Subsequently, the camera assembly may capture a second lower image of the cooktop surface. The controller may determine that a second heating element (different from the first heating element) is covered (e.g., by at least 80%). Accordingly, the controller may establish a second cooktop-use profile based on the second lower image. The second cooktop-use profile may include the second user and the second heating element, as well as a second set of controls.

The controller may recognize either the first user or the second user as they approach the cooktop appliance. For instance, the camera assembly may capture an image of the first user approaching the cooktop appliance. The controller may then enable or activate the first set of controls (e.g., on the image monitor). Accordingly, the controller may disable or deactivate the second set of controls. For instance, the second set of controls relating to the second heating element and the second cooktop-use profile may not be displayed on the image monitor. Advantageously, the first user can easily control the first heating element without mistaking the heating elements and potentially ruining each individual cooking operation. Similarly, the camera assembly may capture an image of the second user approaching the cooktop appliance. The controller may then activate or enable the second set of controls while disabling or deactivating the first set of controls.

It should be understood that the system may establish or store any suitable number of cooktop-use profiles. For instance, when the cooktop appliance contains four heating elements, the system may separately store four cooktop-use profiles which may be presented interchangeably on the image monitor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking engagement system defining a vertical direction, a lateral direction, and a transverse direction, the cooking engagement system comprising:

a cooktop appliance defining a top surface, the cooktop appliance comprising a plurality of heating elements defined on the top surface;

a camera assembly positioned above the cooktop appliance; and a controller operably coupled with the camera assembly and the cooktop appliance, the controller being configured to initiate an operation, the operation comprising:

directing a capture of a first front image at the camera assembly;

identifying a first user based on the first front image;

directing a capture of a first lower image at the camera assembly;

establishing a first cooktop-use profile based on the first lower image; and associating the identified first user with the first cooktop-use profile.

2. The cooking engagement system of claim 1, wherein establishing the first cooktop-use profile comprises determining that a predetermined percentage of a first heating element from the plurality of heating elements is covered, the predetermined percentage being between 75% and 85%.

3. The cooking engagement system of claim 2, wherein the cooktop appliance defines a top surface facing upward along the vertical direction, the cooking engagement system further comprising:

an image monitor spaced apart from the top surface of the cooktop appliance along the vertical direction.

4. The cooking engagement system of claim 3, wherein the camera assembly comprises:

a first camera provided on a front of the image monitor and facing along the transverse direction; and a second camera provided on a bottom of the image monitor and facing along the vertical direction toward the top surface of the cooktop appliance.

5. The cooking engagement system of claim 4, wherein the operation further comprises:

directing a capture of a second front image at the camera assembly;

identifying a second user based on the second front image;

directing a capture of a second lower image at the camera assembly;

establishing a second cooktop-use profile based on the second lower image; and associating the identified second user with the second cooktop-use profile.

6. The cooking engagement system of claim 5, wherein establishing the second cooktop-use profile comprises determining that a second heating element from the plurality of heating elements is covered with a cooking utensil.

7. The cooking engagement system of claim 6, wherein the operation further comprises:

recognizing the first user at the camera assembly subsequent to establishing the first cooktop-use profile;

enabling a first set of controls to allow manipulation of the first heating element in response to recognizing the first user; and disabling a second set of controls to prohibit manipulation of the second heating element in response to enabling the first set of controls.

8. The cooking engagement system of claim 7, wherein the operation further comprises:

recognizing the second user at the camera assembly subsequent to establishing the second cooktop-use profile;

disabling the first set of controls for the first heating element in response to recognizing the second user; and enabling the second set of controls for the second heating element in response to disabling the first set of controls.

9. The cooking engagement system of claim 7, wherein the image monitor comprises a touch screen, and wherein enabling the first set of controls comprises:

displaying the first set of controls on the image monitor, wherein the first set of controls are touch controls on the image monitor.

10. The cooking engagement system of claim 1, wherein the operation further comprises:

receiving a deactivation command; and adjusting the first cooktop-use profile in response to receiving the deactivation command.

11. A method of operating a cooking engagement system, the cooking engagement system comprising a cooktop appliance comprising a top surface defining a plurality of heating elements, an image monitor provided above the cooktop appliance, and a camera assembly connected to the image monitor, the method comprising:

activating the camera assembly to capture a first front image;

performing a first image analysis on the first front image to recognize a first user;

activating the camera assembly to capture a first lower image;

performing a second image analysis on the first lower image to recognize a first heating element from the plurality of heating elements; and linking the first user with the first heating element to define a first cooktop-use profile.

12. The method of claim 11, wherein recognizing the first heating element comprises determining that a predetermined percentage of the first heating element is covered.

13. The method of claim 12, wherein the predetermined percentage is between 75% and 85%.

14. The method of claim 11, wherein the camera assembly comprises:

a first camera provided on a front of the image monitor and facing along a transverse direction; and a second camera provided on a bottom of the image monitor and facing along a vertical direction toward the top surface of the cooktop appliance.

15. The method of claim 11, further comprising:

activating the camera assembly to capture a second front image;

performing a third image analysis on the second front image to recognize a second user;

activating the camera assembly to capture a second lower image;

performing a fourth image analysis on the second lower image to recognize a second heating element from the plurality of heating elements; and linking the second user with the second heating element to define a second cooktop-use profile.

16. The method of claim 15, wherein recognizing the second heating element comprises determining that the second heating element is covered with a cooking utensil.

17. The method of claim 16, further comprising:

recognizing the first user at the camera assembly subsequent to establishing the first cooktop-use profile;

enabling a first set of controls for the first heating element in response to recognizing the first user; and disabling a second set of controls for the second heating element in response to enabling the first set of controls.

18. The method of claim 17, further comprising:

recognizing the second user at the camera assembly subsequent to establishing the second cooktop-use profile;

disabling the first set of controls for the first heating element in response to recognizing the second user; and enabling the second set of controls for the second heating element in response to disabling the first set of controls.

19. The method of claim 17, wherein the image monitor comprises a touch screen, and wherein enabling the first set of controls comprises:

displaying the first set of controls on the image monitor, wherein the first set of controls are touch controls on the image monitor.

20. The method of claim 11, further comprising:

receiving a command to cease an operation of the first heating element; and delinking the first user from the first heating element.

* * * * *